US005419611A

United States Patent [19]

Cook

[11] Patent Number: 5,419,611

[45] Date of Patent: May 30, 1995

[54] FOOTREST ASSEMBLY FOR RECLINING CHAIR

[75] Inventor: Robert E. Cook, New Albany, Miss.

[73] Assignee: Super Sagless Corporation, Tupelo, Miss.

[21] Appl. No.: 958,961

[22] Filed: Oct. 9, 1992

[51] Int. Cl.[6] ..... A47C 1/02

[52] U.S. Cl. ..... 297/85; 297/75

[58] Field of Search ..... 297/68, 69, 70, 75, 297/76, 83, 84, 85, 86, 87, 88, 89

[56] References Cited

U.S. PATENT DOCUMENTS

| | | | |
|---|---|---|---|
| 2,670,030 | 2/1954 | Richardson | 297/75 |
| 2,892,484 | 6/1959 | Barabas | 297/83 |
| 3,494,660 | 2/1970 | Caldeimeyer et al. | 297/75 X |
| 3,781,060 | 12/1973 | Pentzien | 297/68 |
| 3,893,472 | 7/1959 | Repaich | 297/75 |
| 3,941,417 | 3/1976 | Re | 297/85 |
| 4,236,754 | 12/1980 | Ehlers | 297/68 X |
| 4,477,118 | 10/1984 | Ruble | 297/68 |
| 4,669,778 | 6/1987 | Rogers, Jr. | 297/68 X |
| 4,707,025 | 11/1987 | Rogers, Jr. | 297/83 X |

FOREIGN PATENT DOCUMENTS

| | | | |
|---|---|---|---|
| 0879229 | 10/1961 | United Kingdom | 297/75 |

*Primary Examiner*—Kenneth J. Dorner
*Assistant Examiner*—Milton Nelson, Jr.

[57] ABSTRACT

Motion furniture seating having an ottoman assembly including a main ottoman and a mid-ottoman and wherein each of the ottomans includes a foot supporting panel and side panels. When the assembly is retracted the mid-ottoman nests inside the main ottoman beneath the seat and when the assembly is extended the foot supporting panels lie in substantially the same plane as a continuation of the seat and the side panels extend downwardly from the foot supporting panels and essentially hide the mechanism which carries the ottomans and inhibits access to the mechanism by a child or animal so as to avoid injury.

20 Claims, 6 Drawing Sheets

FOOTREST ASSEMBLY FOR RECLINING CHAIR

FIELD OF THE INVENTION

This invention relates to motion furniture and more particularly comprises a new and improved footrest assembly for reclining chairs and other seating, which has both a main and mid-ottoman.

BACKGROUND OF THE INVENTION

So called "motion furniture" including reclining chairs have enjoyed great popularity in the furniture industry, and significant research and development work is constantly being conducted to improve both their comfort, function and design as well as to reduce their costs. One area that has been given particular attention recently is the footrest assembly in reclining chairs, which is stored under the seat when the chair is in the upright position and which is extended when the chair is in the reclined position. Footrest assemblies frequently include a lazy tong linkage mechanism which at its end supports a main ottoman that is oriented forward from and at the approximate height of the seat cushion of the chair when the chair is reclined. In more recent years, to increase the safety and comfort of the chair and to give the chair when in the reclined position a chaise lounge-type look, mid-ottomans have been added to the footrest assembly, which are disposed between the front edge of the seat cushion and the rear edge of the main ottoman when the footrest assembly is elevated. The mid-ottoman improves the comfort of the chair by providing support for the legs in the calf area, improves the safety of the chair by limiting access to the mechanism which can pinch the hands or clothing of the chair occupant or a limb or even the head of a small child who may be playing near the chair as it is being moved to the upright position, and improves the aesthetics of the chair by hiding some of the mechanical parts thereof.

In much of the prior art, the geometry of the footrest assembly creates a gap between the edges of the mid-ottoman and the front edge of the seat cushion and the rear edge of the main ottoman. Frequently, special upholstering is employed to close those gaps and in some instances to create the appearance of a continuous chaise-like seat and leg support when the chair is reclined. To provide proper storage for the mid-ottoman in most of the prior art designs, the mid-ottoman is substantially narrower than the main ottoman, and the mid-ottoman does not include upholstered side panels on each side of the chair. Consequently, the mechanism, is wholly exposed when the chair is viewed from the side. The geometry of the mechanism and the way in which the mid-ottoman is retracted beneath the seat and behind the main ottoman does not permit the mid-ottoman to carry side panels that at least partially cover the mechanism and generally enhance the beauty of the chair.

The principle object of the present invention is to provide a footrest assembly for reclining chairs, which has a mid-ottoman whose edges lie closely adjacent the front edge of the seat cushion and the rear edge of the main ottoman and which has side panels that at least partially cover the mechanism of the footrest assembly when the chair is in the reclined position so as to prevent a child from getting its head or extremities trapped in the mechanism.

Another important object of the present invention is to provide a footrest assembly that creates a chaise lounge-like look when the chair is reclined, at significantly less manufacturing cost than incurred with other designs.

Yet another important object of the present invention is to provide a very simple mid-ottoman subassembly that may be integrated into existing footrest mechanisms without appreciable modification of the lazy tong linkage that supports the main ottoman.

Yet another important object of the present invention is to provide a mid-ottoman subassembly that includes side panels that cover at least a portion of the lazy tong linkage when the footrest assembly is elevated.

Still another important object of the present invention is to provide a footrest assembly with wrap around main and mid ottomans.

Another important object of this invention is to provide a lazy tong linkage for footrest assemblies that causes the mid ottoman to nest within the main ottoman when retracted.

Another object of the present invention is to provide a linkage mechanism for footrest assemblies having both mid and main ottomans, which directly connects the two ottomans together to insure that they operate in unison and maintain the proper relationship with one another.

SUMMARY OF THE INVENTION

To accomplish these and other objects, the present invention includes what may be termed wrap around main and mid-ottomans that are carried by the lazy tong linkage and which are substantially the full width of the seat cushion of the reclining chair or other seating with which the footrest assembly is used. The side panels of the ottomans extend downwardly about the linkage when the footrest assembly is elevated to the operative position so as to cover the mechanism and inhibit access to it. The mid-ottoman when the chair is upright is stored beneath the seat in telescopic relationship with the main ottoman, that is, the side panels of the mid-ottoman lie just inside the side panels of the main ottoman. To accommodate the side panels of the mid-ottoman when the footrest assembly is retracted, the mounting linkage for the mid-ottoman is stacked inwardly of the mechanism that supports the main ottoman so that the side panels of the mid-ottoman lie between the mounting linkage which supports it and the side panels of the main ottoman.

The mounting linkage subassembly for the mid-ottoman includes a crank pivotally supported intermediate its ends on a bracket fixed to the inner of the links of the lazy tong that carries the main ottoman, and a drive link pivotally connected to the crank and the main ottoman bracket controls the position of the mid-ottoman with respect to the main ottoman. The links that support the main ottoman are L-shaped so as not to interfere with the mid-ottoman when it is retracted.

These and other objects and features of this invention will be better understood and appreciated from the following detailed description of one embodiment thereof, selected for purposes of illustration and shown in the accompanying drawings.

DETAILED DESCRIPTION OF THE PREFERRED EMBODIMENT

The present invention provides an extendable footrest assembly having a main ottoman and a mid-ottoman. While the footrest assembly of the present invention is described herein for use with a particular reclining chair, it is to be appreciated that the footrest assembly can be utilized with a variety of motion furniture seating including chairs, sofas, and love seats. Specifically, the chair shown is a rocker-recliner and includes a rocker blocker that prevents the chair from rocking when the chair is reclined. The chair shown is also gravity actuated and retained in the upright position by a latching device (not shown). To move the chair to the reclined position, a push-button actuator is depressed, which releases the latching device, and gravity drives the seat forwardly and downwardly, activates the rocker blocker and elevates the footrest assembly. It is to be understood, however, that other kinds of footrest actuation are envisioned including handle actuated footrest linkages, and the seating may simply be a recliner and not a rocker recliner. Furthermore, the chair may be either a three-way or two-way recliner (with the seat and backrest fixed with respect to one another). Because the details of the chair are not material to the footrest assembly, only so much of the reclining chair as is necessary for an understanding of the invention will be described herein.

Figure 1:
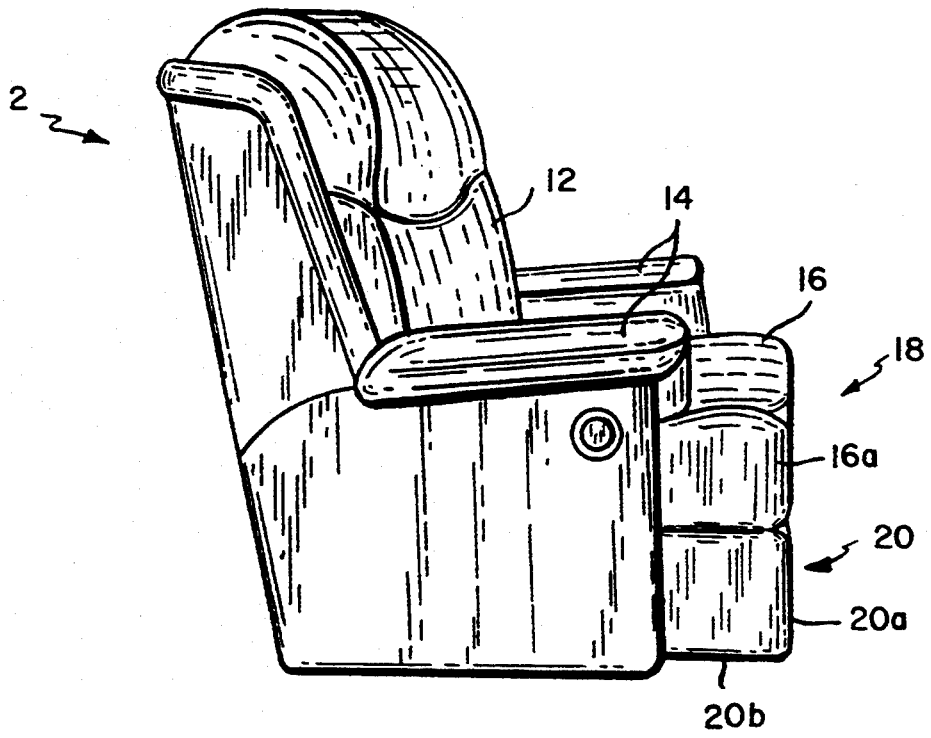
FIG. 1 is a perspective view of a reclining chair having an ottoman assembly constructed in accordance with the present invention with the chair shown in its upright position.
Figure 2:
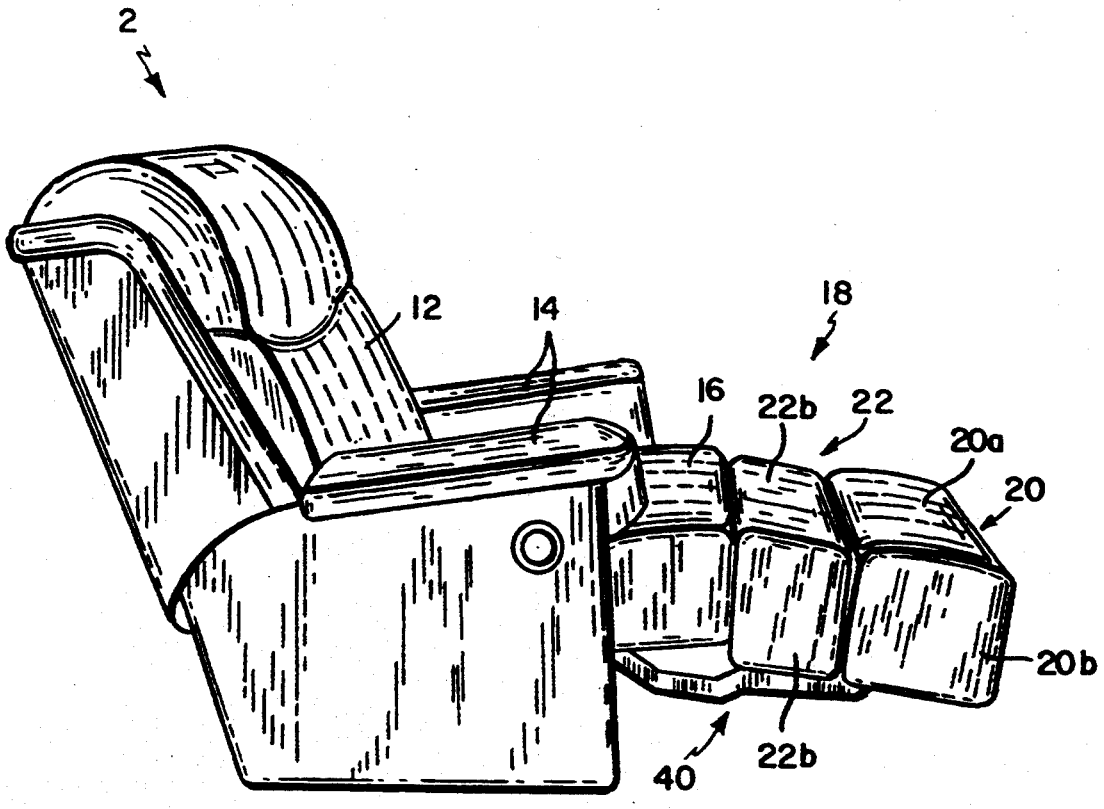
FIG. 2 is a perspective view of the chair shown in FIG. 1 and with the chair in the reclined position and its footrest elevated.
Figure 4:
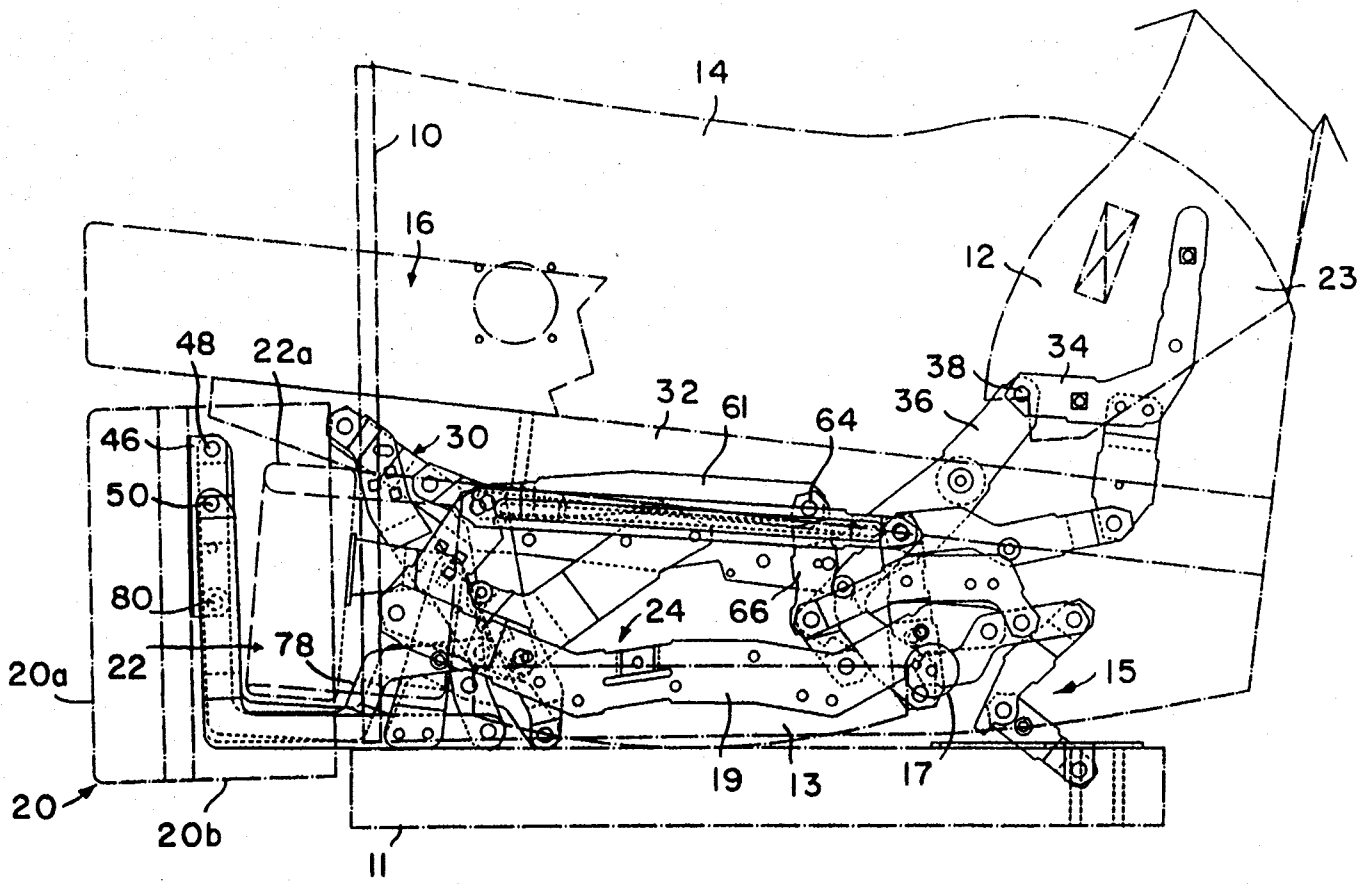
FIG. 4 is a diagrammatic fragmentary side elevation view of the chair shown in FIGS. 1 and 2 in the upright position with the footrest assembly retracted and particularly illustrating the reclining mechanism and the footrest linkage.
Figure 5:
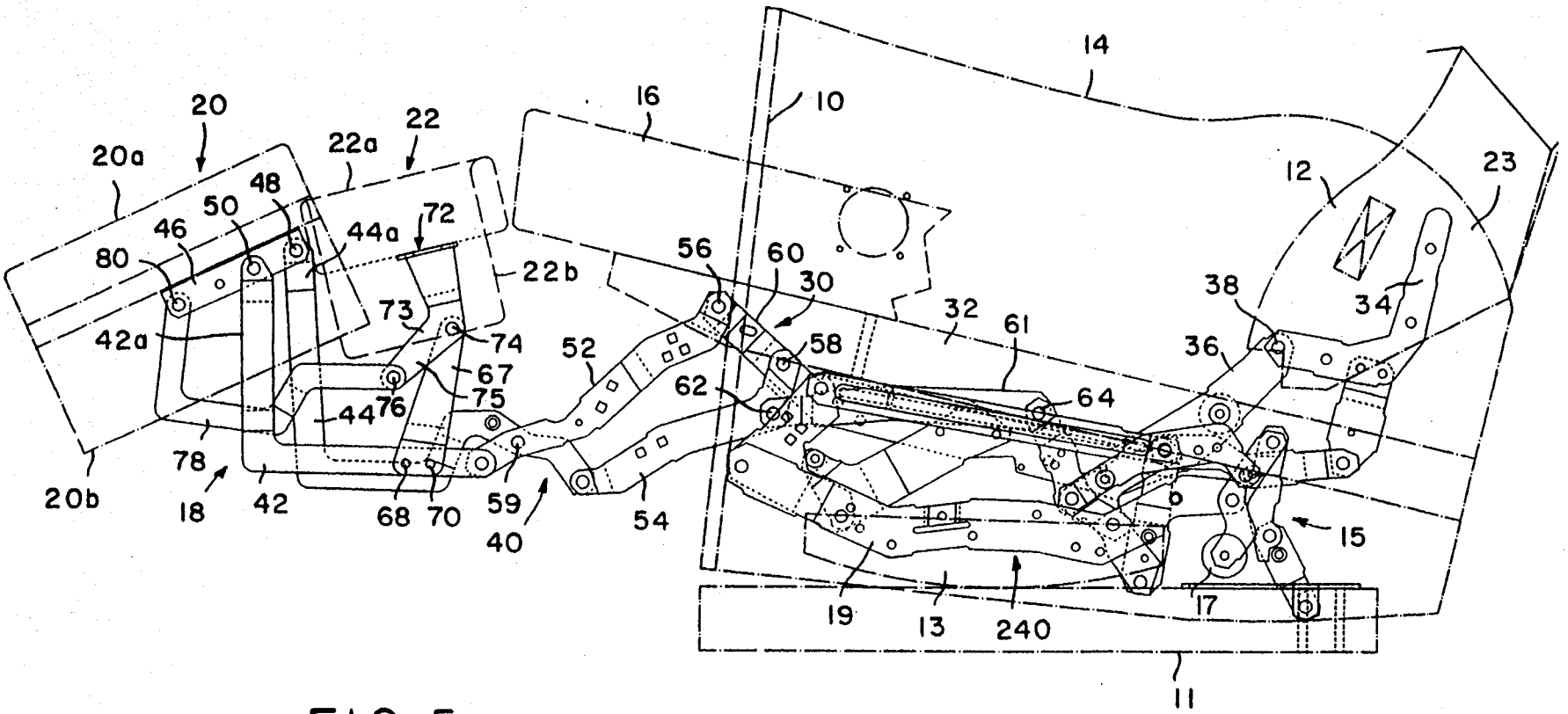
FIG. 5 is a view similar to FIG. 4 but on a reduced scale showing the footrest assembly in a partially extended position.
Figure 6:
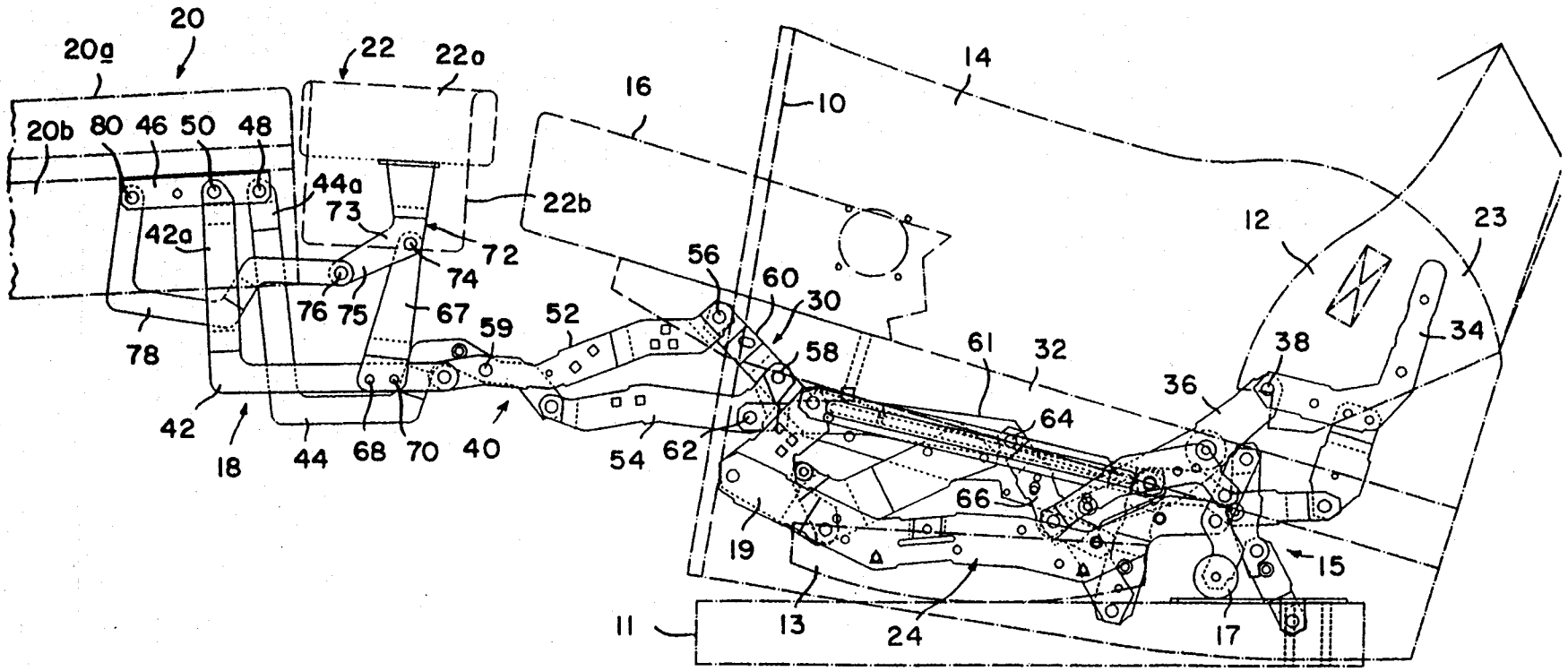
FIG. 6 is a view similar to FIG. 5 but showing the footrest assembly in its fully extended position.

In FIGS. 1 and 2, the reclining chair 2 shown embodying the invention includes a backrest 12, armrests 14, seat 16 and footrest assembly 18. The footrest assembly 18 includes a main ottoman 20 and mid-ottoman 22, both of which are carried by a lazy tong linkage 40 that is connected to the main linkage mechanism 24 of the chair shown in detail in FIGS. 4–7. In FIGS. 4–6, the chair is shown to include a base 11 on which a rocker cam 13 is mounted for "to and fro" rocking motion when the rocker blocker 15 is retracted. In FIG. 4, the blocker 15 including its roller 17 is retracted to allow the chair 2 to rock on its rocker cam 13. In FIG. 6 the rocker blocker 15 is activated so that its roller 17 engages the base 11 and prevents the rocking motion.

The rocker cam 13 carries the reclining chair linkage mechanism 24 by means of a base plate 19 which is secured to it. The base plate 19 through a series of links carries the frame 32 of seat 16, the frames 10 of armrests 14 and the frame 23 of backrest 12. It should be appreciated that the rocker cam 13 and chair mechanism 24 including the lazy tong linkage of the footrest assembly are duplicated on each side of the chair, and one is the mirror image of the other. The reclining chair mechanism 24 including the rocker blocker 15 and the support for the seat and backrest exists in the prior art and its details are not part of this invention.

The footrest assembly 18 shown in FIGS. 4–6, includes the main ottoman 20, a mid-ottoman 22 and lazy tong linkage 40. In this embodiment, the lazy tong linkage is mounted on the seat mounting link 30 of the reclining chair mechanism 24, and is operable to move from its retracted position of FIG. 4 to the partially extended position of FIG. 5, and beyond to the fully extended position of FIG. 6.

Both the main ottoman 20 and mid-ottoman 22 are U-shaped. The main ottoman has a leg supporting panel 20*a* and side panels 20*b* that extend downwardly from the panel 20*a* when the leg rest assembly is in the extended or operative position of FIG. 6, so as to hide at least portions of the lazy tong linkage 40 from view, and extend rearwardly from the panel 20*a* when the assembly is retracted as in FIG. 4. The mid-ottoman 22 also has a leg supporting panel 22*a* and side panels 22*b* that are oriented in the same position as the corresponding parts of the main ottoman as shown in FIGS. 4 and 6.

In the retracted position of FIGS. 1 and 4, main ottoman 20 and mid-ottoman 22 are located beneath seat 16, and mid-ottoman 22 nests within the main ottoman 20 with the panels 20*a* and 22*a* disposed in closely spaced and substantially parallel vertical planes.

Referring to FIG. 5, the mechanism 24 includes the seat mounting link 30 which is connected to the frame 32 of seat 16 so that the seat 16 moves with the seat mounting link 30. Backrest 12 is carried by backrest link 34 which is pivotally connected by rivet 38 to the rear portion 36 of seat mounting link 30. As is conventional in three-way recliners, the backrest 12 remains fixed with respect to the seat 16 when the chair moves from the upright position to the intermediate reclining or TV position but moves relative to the seat when the chair moves from the TV to the fully reclined position.

Lazy tong linkage 40 includes L-shaped swing links 42 and 44 which are pivotally connected at their ends 42*a* and 44*a*. To main ottoman bracket 46 by rivets 50 and 48, respectively. The ends 42*a* and 44*a* are disposed on the inner and outer faces, respectively, of the bracket 46. The swing links 42 and 44 are connected at their other ends to a second pair of swing links 52 and 54, respectively, that in turn are pivotally connected by rivets 56 and 58 to the forward end 60 of seat mounting link 30. The swing link 52 is pivotally connected intermediate its ends to the link 44 by rivet 59. Movement of the footrest assembly between retracted and extended positions is achieved conventionally through opening and closing of the lazy tong linkage 40.

Drive link 61, which provides the driving force for lazy tong linkage 40, is pivotally connected at its forward end by rivet 62 to swing link 54 of the lazy tong linkage. Drive link 61 is pivotally connected at its rear end by rivet 64 to rear pivot link 66. The drive link 61 is actuated as the rear pivot link pivots counterclockwise as viewed in FIG. 4 as the seat moves forwardly from the upright to the reclined position. Drive link 61 may alternatively be actuated by other known footrest actuating mechanisms such as a handle, either independently of or together with the seat.

Figure 7:
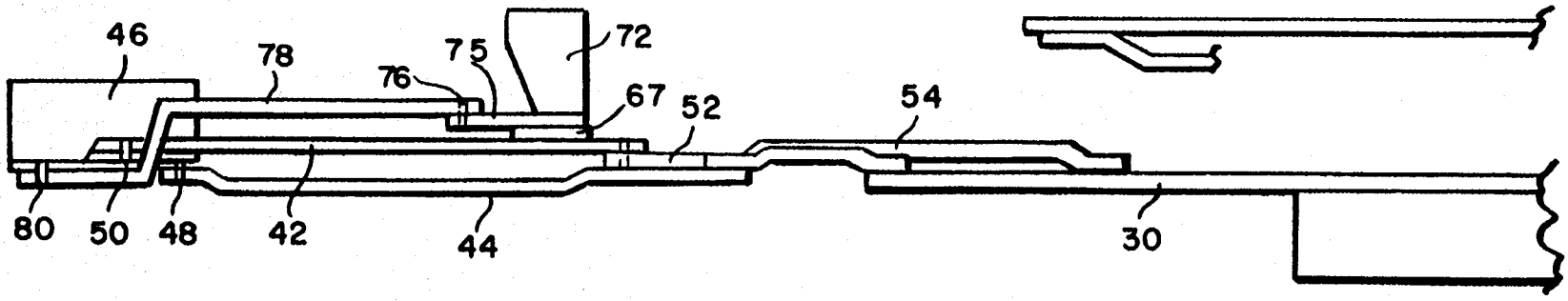
FIG. 7 is a bottom plan view of the mechanism of the footrest assembly in the extended position.
Figure 8:
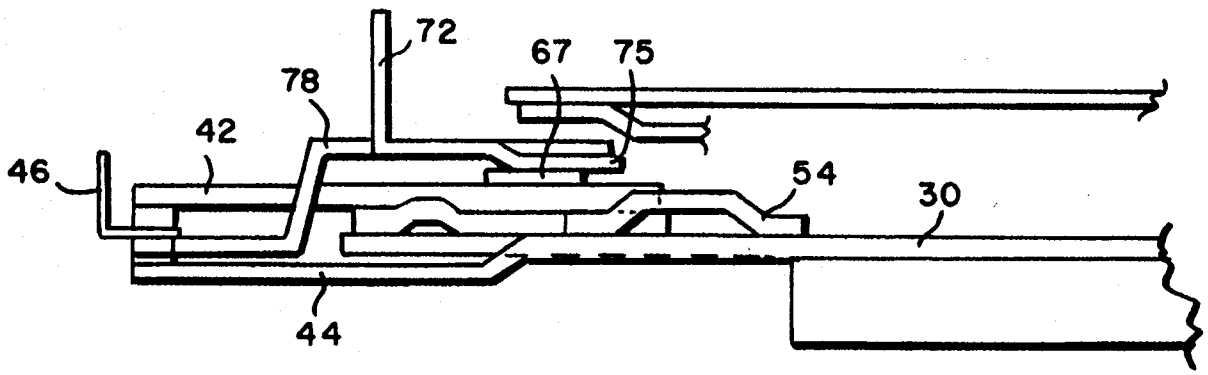
FIG. 8 is a view similar to FIG. 7 with the assembly in the retracted position.

It will be noted particularly in FIGS. 5–7 that the swing links 52 and 54 are mounted on the inner face (or inboard) of the seat mounting link 30 and that ottoman swing link 42 is disposed inboard of the link 52 and its companion swing link 44. This arrangement enables the mid-ottoman 22 to have the wrap around or U-shaped configuration rather than simply a single panel configuration as found in the prior art.

The lazy tong linkage 40 includes a mid-ottoman mounting link 67 which is secured at its lower end by rivets 68 and 70 to swing link 42. A mid-ottoman bracket 72, in the form of an L-shaped crank, is pivotally mounted at its bend 73 by rivet 74 to the inner face of the upper end of the mid-ottoman mounting link 67. Mid-ottoman bracket 72 carries the mid-ottoman 22 at one end. An ottoman drag link 78 is pivotally connected at one end by rivet 80 to main ottoman bracket 46 and is pivotally connected at is other end by rivet 76 to the free end 75 of mid-ottoman bracket 72. The ottoman drag link 78 provides a direct connection between the mid-ottoman 22 and main ottoman 20. When the main ottoman 20 is raised to its fully extended, operative position of FIG. 6, the drag link 78 turns the crank-shaped mid-ottoman bracket 72 to raise the mid-ottoman 22 to its operative position also shown in FIG. 6. The direct connection between the mid-ottoman and main ottoman provides for smooth, reliable movement of the mid-ottoman when the main ottoman is moved. This direct connection additionally insures that the mid-ottoman is properly positioned relative to the main ottoman during all positions of the main ottoman. It is to be appreciated that the surface of the mid-ottoman 22 is substantially continuous with the surface of the seat 16 and main ottoman 20 when the footrest assembly is fully extended to provide a most comfortable support for the legs of the chair occupant.

Figure 3:
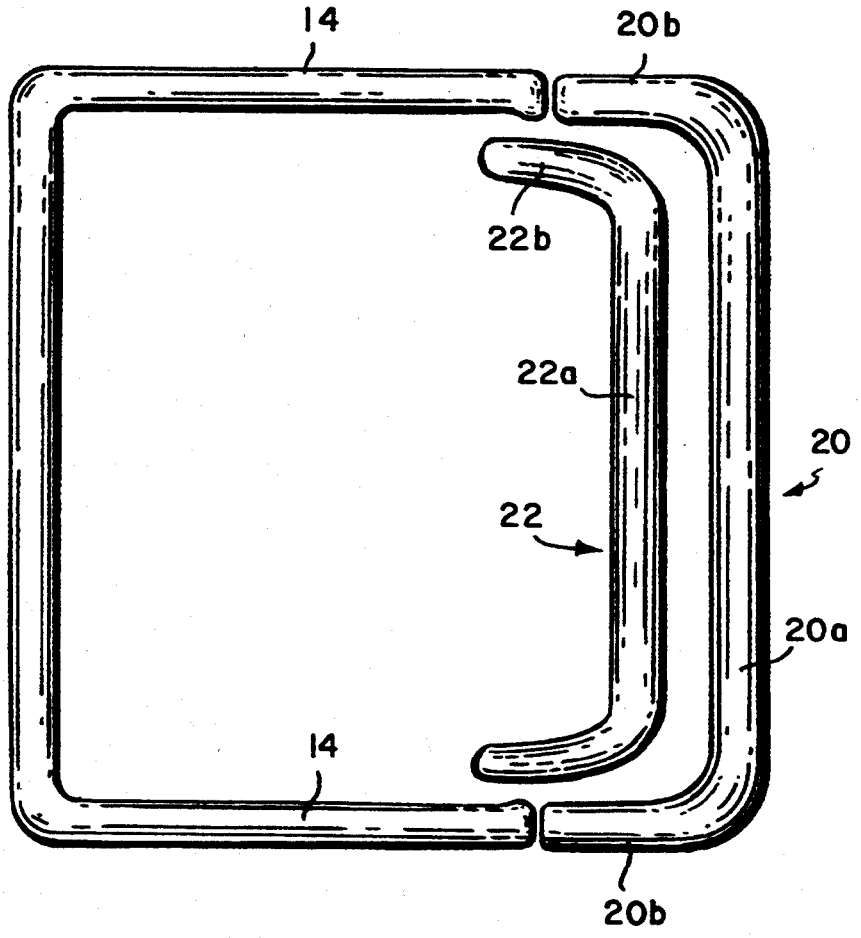
FIG. 3 is a fragmentary bottom plan view of the chair of FIG. 1 with the footrest assembly in the retracted position and with the mechanism omitted for clarity.

Mid-ottoman 22 is slightly narrower than main ottoman 20 to permit its storage behind and within main ottoman 20 when the footrest is in the retracted position, as shown in FIGS. 3 and 4, but may be fully padded and upholstered to match that of the remainder of the chair. The footrest assembly may be moved from the fully extended position back to the retracted position by the chair occupant applying downward pressure to the main ottoman 20, which causes the lazy tong linkage to fold to the position of FIG. 4. Alternatively, it may be achieved in other known manners such as with an actuating handle, etc.

The present invention provides a footrest arrangement in which the mid-ottoman occupies the gap between the main ottoman and the seat when the footrest is fully extended. The wrap around configuration of the two ottomans substantially hides the lazy tong linkage 40, and the chair has a distinctive chaise lounge-like appearance. The direct connection between the mid-ottoman and the main ottoman created by the drag link 78 provides smooth, reliable and cooperative movement of the two ottomans with minimum linkage.

In FIGS. 1 and 3 it will be noted that when the chair is upright, the panel 20*a* of the main ottoman 20 is essentially vertical and is aligned with the front edge 16*a* of the seat 16, and the ottoman side panels 20*b* are essentially aligned with the arms 14 of the chair. The mid-ottoman 22 is enclosed by the arms 14, seat 16 and main ottoman 20 and thus is hidden from view.

Having described a preferred embodiment of the invention, it should be apparent to those skilled in the art that numerous other embodiments and modifications thereof are contemplated as falling within the scope of the present invention as defined by the appended claims.

What is claimed is:

1. A reclining chair comprising:

a support;

a motion mechanism mounted on the support and having a seat link;

a seat mounted on the seat link and movable between an upright and a reclined position;

a main ottoman linkage having first and second swing links pivoted on the seat link and third and fourth swing links pivoted at one end on the first and second swing links, respectively;

a main ottoman bracket directly attached to the other ends of the third and fourth swing links and carrying a main ottoman;

a drive link connected to the first swing link and responsive to movement of the seat from upright to reclined position for causing the ottoman linkage to move the main ottoman from a stored position beneath the seat to an elevated position substantially in the plane of the seat;

a mid-ottoman mounting link secured to and movable with the fourth ottoman swing link;

a mid-ottoman bracket pivotally mounted on the mid-ottoman mounting link and carrying a mid-ottoman; and an ottoman drag link connected between the main ottoman bracket and the mid-ottoman bracket for pivoting the mid-ottoman from a retracted position beneath the seat to a raised position wherein the mid-ottoman lies substantially in the plane of and extends between the seat and main ottoman when the main ottoman moves to the elevated position.

2. A reclining chair as recited in claim 1 wherein the mid-ottoman bracket is substantially L-shaped.

3. A reclining chair as recited in claim 1 wherein the ottoman drag link is pivotally connected, at one end thereof, to the main ottoman bracket and pivotally connected, at the other end thereof, to the mid-ottoman bracket.

4. A reclining chair as recited in claim 1 wherein the mid-ottoman bracket carries, at one end thereof, the mid-ottoman and is pivotally connected, at another end thereof, to the ottoman drag link.

5. A reclining chair as recited in claim 1 wherein the mid-ottoman, in the retracted position, nests within the main ottoman.

6. An ottoman assembly as defined in claim 1 wherein the mid-ottoman is slightly narrower than the main ottoman so that when the ottomans are nested, side panels of the mid-ottoman lie inside side panels of the main ottoman.

7. A reclining chair comprising:

a support;

a motion mechanism mounted on the support and having a seat link;

a seat mounted on the seat link and movable between an upright and a reclined position;

a main ottoman linkage having first and second swing links pivoted on the seat link and third and fourth swing links pivoted at one end on the first and second swing links, respectively;

a main ottoman bracket attached to the other ends of the third and fourth swing links and carrying a main ottoman;

a drive link connected to the first swing link and responsive to movement of the seat from upright to reclined position for causing the ottoman linkage to move the main ottoman from a stored position beneath the seat to an elevated position substantially in the plane of the seat;

a mid-ottoman mounting link secured to and movable with the fourth ottoman swing link;

a mid-ottoman bracket pivotally mounted on the mid-ottoman mounting link and carrying a mid-ottoman;

an ottoman drag link connected between the main ottoman bracket and the mid-ottoman bracket for pivoting the mid-ottoman from a retracted position beneath the seat to a raised position wherein the mid-ottoman lies substantially in the plane of and extends between the seat and main ottoman when the main ottoman moves to the elevated position;

wherein the mid-ottoman bracket is substantially L-shaped; and, wherein the mid-ottoman bracket is pivotally mounted on the mid-ottoman mounting link at a substantially central location of the mid-ottoman bracket.

8. A reclining chair as recited in claim 7 wherein the ottoman drag link is pivotally connected, at one end thereof, to the main ottoman bracket and pivotally connected, at the other end thereof, to the mid-ottoman bracket.

9. A reclining chair as recited in claim 8 wherein the mid-ottoman bracket carries, at one end thereof, the mid-ottoman and is pivotally connected, at another end thereof, to the ottoman drag link.

10. A reclining chair comprising:

a support;

a motion mechanism mounted on the support and having a seat link;

a seat mounted on the seat link and movable between an upright and a reclined position;

a main ottoman linkage having first and second swing links pivoted on the seat link and third and fourth swing links pivoted at one end on the first and second swing links, respectively;

a main ottoman bracket attached to the other ends of the third and fourth swing links and carrying a main ottoman;

a drive link connected to the first swing link and responsive to movement of the seat from upright to reclined position for causing the ottoman linkage to move the main ottoman from a stored position beneath the seat to an elevated position substantially in the plane of the seat;

a mid-ottoman mounting link secured to and movable with the fourth ottoman swing link;

a mid-ottoman bracket pivotally mounted on the mid-ottoman mounting link and carrying a mid-ottoman; and an ottoman drag link connected between the main ottoman bracket and the mid-ottoman bracket for pivoting the mid-ottoman from a retracted position beneath the seat to a raised position wherein the mid-ottoman lies substantially in the plane of and extends between the seat and main ottoman when the main ottoman moves to the elevated position;

wherein the mid-ottoman bracket is substantially L-shaped; wherein the mid-ottoman, in the retracted position, nests within the main ottoman; and, wherein the main ottoman and mid-ottoman are substantially U-shaped, each having a foot support panel and two side panels.

11. An extendable footrest comprising:

a support;

a seat link mounted on the support;

a seat mounted on the seat link;

an ottoman linkage having first and second swing links pivoted on the seat link and third and fourth swing links pivoted at one end on the first and second swing links, respectively;

an ottoman bracket directly attached to the other ends of the third and fourth swing links and carrying a main ottoman;

a drive link connected to one of the swing links for causing the ottoman linkage to move the main ottoman from a stored position beneath the seat to an elevated position substantially in the plane of the seat;

a mid-ottoman mounting link secured to one of the third and fourth swing links and movable with that link;

a mid-ottoman bracket pivotally mounted on the mid-ottoman mounting link and carrying a mid-ottoman; and an ottoman drag link connected between the main ottoman bracket and the mid-ottoman bracket for pivoting the mid-ottoman from a retracted position beneath the seat to a raised position wherein the mid-ottoman lies substantially in the plane of and extends between the seat and main ottoman when the main ottoman moves to the elevated position.

12. A reclining chair as recited in claim 11 wherein the mid-ottoman bracket is a crank.

13. A reclining chair as recited in claim 10 wherein the ottoman drag link is pivotally connected, at one end thereof, to the main ottoman bracket and pivotally connected, at the other end thereof, to the mid-ottoman bracket.

14. A reclining chair as recited in claim 11 wherein the mid-ottoman bracket carries, at one end thereof, the mid-ottoman and is pivotally connected, at another end thereof, to the ottoman drag link.

15. A reclining chair as recited in claim 11 wherein the mid-ottoman in the retracted position, nests within the main ottoman.

16. An extendable footrest comprising:

a support;

a seat link mounted on the support;

a seat mounted on the seat link;

an ottoman linkage having first and second swing links pivoted on the seat link and third and fourth swing links pivoted at one end on the first and second swing links, respectively;

an ottoman bracket attached to the other ends of the third and fourth swing links and carrying a main ottoman;

a drive link connected to one of the swing links for causing the ottoman linkage to move the main ottoman from a stored position beneath the seat to an elevated position substantially in the plane of the seat;

a mid-ottoman mounting link secured to one of the third and fourth swing links and movable with that link;

a mid-ottoman bracket pivotally mounted on the mid-ottoman mounting link and carrying a mid-ottoman; and an ottoman drag link connected between the main ottoman bracket and the mid-ottoman bracket for pivoting the mid-ottoman from a retracted position beneath the seat to a raised position wherein it lies substantially in the plane of and extends between the seat and main ottoman when the main ottoman moves to the elevated position wherein the mid-ottoman bracket is a crank;

wherein the mid-ottoman bracket is pivotally mounted on the mid-ottoman mounting link at a substantially central location of the mid-ottoman bracket;

wherein the mid-ottoman in the retracted position, nests within the main ottoman; and, wherein the main ottoman is substantially U-shaped with a footrest panel and vertical side panels.

17. A footrest assembly for motion furniture comprising a lazy tong linkage having ends that are inner and outer ends relative to a furniture seat, the linkage being movable between retracted and operative positions, a swing link at the outer end of the linkage, a main ottoman mounting bracket connected to the swing link, a mid-ottoman mounting link connected to the swing link, a mid-ottoman mounting bracket pivotally connected to the mid-ottoman mounting link, and a drag link connected to both the main and mid-ottoman brackets for pivoting the mid-ottoman bracket to an operative position in response to movement of the main ottoman bracket to an operative position.

18. An extendable footrest comprising:

a support;

a seat link mounted on the support;

a seat mounted on the seat link;

an ottoman linkage having first and second swing links pivoted on the seat link and third and fourth swing links pivoted at one end on the first and second swing links, respectively;

an ottoman bracket attached to the other ends of the third and fourth swing links and carrying a main ottoman;

a drive link connected to one of the swing links for causing the ottoman linkage to move the main ottoman from a stored position beneath the seat to an elevated position substantially in the plane of the seat;

a mid-ottoman mounting link secured to one of the third and forth swing links and movable with that link;

a mid-ottoman bracket pivotally mounted on the mid-ottoman mounting link and carrying a mid-ottoman; and an ottoman drag link connected between the main ottoman bracket and the mid-ottoman bracket for pivoting the mid-ottoman from a retracted position beneath the seat to a raised position wherein the mid-ottoman lies substantially in the plane of and extends between the seat and main ottoman when the main ottoman moves to the elevated position;

wherein the mid-ottoman bracket is a crank; and wherein the mid-ottoman bracket is pivotally mounted on the mid-ottoman mounting link at a substantially central location of the mid-ottoman bracket.

19. A reclining chair as recited in claim 18 wherein the ottoman drag link is pivotally connected, at one end thereof, to the main ottoman bracket and pivotally connected, at the other end thereof, to the mid-ottoman bracket.

20. A reclining chair as recited in claim 19 wherein the mid-ottoman bracket carries, at one end thereof, the mid-ottoman and is pivotally connected, at another end thereof, to the ottoman drag link.

* * * * *